US009557084B2

(12) United States Patent
Thogersen et al.

(10) Patent No.: US 9,557,084 B2
(45) Date of Patent: Jan. 31, 2017

(54) APPARATUS FOR CONTROLLING RELATIVE HUMIDITY IN A CONTAINER

(71) Applicant: Thermo King Corporation, Minneapolis, MN (US)

(72) Inventors: Ole Thogersen, Nyborn (DK); Allan Dyrmose, Bogense (DK)

(73) Assignee: THERMO KING CORPORATION, Minneapolis, MN (US)

( * ) Notice: Subject to any disclaimer, the term of this patent is extended or adjusted under 35 U.S.C. 154(b) by 122 days.

(21) Appl. No.: 14/053,981

(22) Filed: Oct. 15, 2013

(65) Prior Publication Data

US 2014/0041402 A1 Feb. 13, 2014

Related U.S. Application Data

(63) Continuation of application No. 12/973,423, filed on Dec. 20, 2010, now abandoned.

(Continued)

(51) Int. Cl.

| | |
|---|---|
| ***F25B 49/00*** | (2006.01) |
| ***F25B 39/02*** | (2006.01) |
| ***F25D 17/06*** | (2006.01) |
| ***F25B 47/02*** | (2006.01) |
| ***F24F 3/14*** | (2006.01) |

(Continued)

(52) U.S. Cl.

CPC ..... *F25B 39/028* (2013.01); *F24F 3/14* (2013.01); *F24F 3/1405* (2013.01); *F25B 47/02* (2013.01); *F25B 47/022* (2013.01); *F25D 16/00* (2013.01); *F25D 17/06* (2013.01); *F25D 17/067* (2013.01); *F24F 2003/144* (2013.01); *F25B 6/02* (2013.01); *F25B 2400/01* (2013.01); *F25B 2400/13* (2013.01); *F25B 2600/112* (2013.01);

(Continued)

(58) Field of Classification Search

CPC . F25B 2600/112; F25B 2700/02; F25B 47/02; F25D 17/067; F25D 16/00; F24F 3/14; F24F 3/1405; F24F 2003/144; F26B 21/002; F26B 21/086

USPC ..... 62/176.1, 176.5, 176.6, 176.2

See application file for complete search history.

(56) References Cited

U.S. PATENT DOCUMENTS

| | | |
|---|---|---|
| 3,503,137 A | 3/1970 | Wilson |
| 3,577,742 A | 5/1971 | Kocher |

(Continued)

FOREIGN PATENT DOCUMENTS

| | | |
|---|---|---|
| CN | 2166684 | 6/1997 |
| CN | 1553128 | 12/2004 |

(Continued)

OTHER PUBLICATIONS

Althouse et al., Modern Refrigeration and Air Conditioning, 2004, The Goodheart-Wilcox Company, Inc., 18th Edition, p. 729.*

(Continued)

*Primary Examiner* — Orlando E Aviles Bosques
*Assistant Examiner* — David Teitelbaum
(74) *Attorney, Agent, or Firm* — Hamre, Schumann, Mueller & Larson, P.C.

(57) ABSTRACT

In one embodiment, a method of operating a refrigeration system includes measuring a relative humidity of a container and comparing the measured relative humidity to a humidity set point. The method also includes operating evaporator fans of a refrigeration system when the measured relative humidity is above the humidity set point.

20 Claims, 2 Drawing Sheets

Related U.S. Application Data

(60) Provisional application No. 61/289,555, filed on Dec. 23, 2009, provisional application No. 61/324,475, filed on Apr. 15, 2010.

(51) Int. Cl.

| | |
|---|---|
| ***F25D 16/00*** | (2006.01) |
| *F26B 21/08* | (2006.01) |
| *F26B 21/00* | (2006.01) |
| *F25B 6/02* | (2006.01) |

(52) U.S. Cl.

CPC ... *F25B 2700/02* (2013.01); *F25B 2700/2104* (2013.01); *F26B 21/002* (2013.01); *F26B 21/086* (2013.01)

(56) References Cited

U.S. PATENT DOCUMENTS

| | | | | |
|---|---|---|---|---|
| 3,977,205 | A | 8/1976 | Dreisziger et al. | |
| 4,109,395 | A | 8/1978 | Huang | |
| 4,179,898 | A | 12/1979 | Vakil | |
| 4,290,480 | A * | 9/1981 | Sulkowski | F24F 11/0009 165/228 |
| 4,317,335 | A | 3/1982 | Nakagawa et al. | |
| 4,474,026 | A | 10/1984 | Mochizuki et al. | |
| 4,559,956 | A | 12/1985 | DeLange et al. | |
| 4,658,596 | A | 4/1987 | Kuwahara | |
| 4,685,309 | A | 8/1987 | Behr | |
| 4,711,294 | A | 12/1987 | Jacobs et al. | |
| 4,744,223 | A * | 5/1988 | Umezu | 62/176.5 |
| 4,910,972 | A | 3/1990 | Jaster | |
| 5,103,650 | A | 4/1992 | Jaster | |
| 5,129,234 | A | 7/1992 | Alford | |
| 5,129,235 | A | 7/1992 | Renken et al. | |
| 5,181,387 | A * | 1/1993 | Meckler | F02G 1/043 62/176.1 |
| 5,271,236 | A * | 12/1993 | Sweetser | 62/155 |
| 5,385,034 | A | 1/1995 | Haselden | |
| 5,400,612 | A | 3/1995 | Hedges | |
| 5,406,805 | A | 4/1995 | Radermacher et al. | |
| 5,493,870 | A * | 2/1996 | Kodama | B60H 1/00907 62/155 |
| 5,557,937 | A | 9/1996 | Haselden | |
| 5,778,147 | A * | 7/1998 | Kim | 392/473 |
| 5,799,614 | A | 9/1998 | Greenwood | |
| 5,974,815 | A | 11/1999 | Hwang et al. | |
| 6,038,874 | A | 3/2000 | van der Walt et al. | |
| 6,138,919 | A | 10/2000 | Cooper et al. | |
| 6,182,454 | B1 | 2/2001 | McNeilan | |
| 6,266,966 | B1 | 7/2001 | Fernandez et al. | |
| 6,370,895 | B1 | 4/2002 | Sakuma et al. | |
| 6,370,908 | B1 | 4/2002 | James | |
| 6,550,261 | B1 * | 4/2003 | Shima et al. | 62/176.1 |
| 6,584,785 | B1 | 7/2003 | Karl | |
| 7,624,740 | B2 | 12/2009 | Lipscomb et al. | |
| 2006/0137371 | A1 | 6/2006 | Knight et al. | |
| 2006/0225444 | A1 * | 10/2006 | Taras | F24F 3/153 62/173 |
| 2006/0288713 | A1 * | 12/2006 | Knight | F24F 3/153 62/176.6 |
| 2007/0137227 | A1 * | 6/2007 | Konopa | F25D 17/042 62/186 |
| 2007/0151288 | A1 | 7/2007 | Nuiding | |
| 2008/0264085 | A1 * | 10/2008 | Perry | F24F 11/0012 62/176.6 |

FOREIGN PATENT DOCUMENTS

| | | |
|---|---|---|
| CN | 1579898 | 2/2005 |
| CN | 2720311 | 8/2005 |
| CN | 201333366 | 10/2009 |
| EP | 2161521 | 3/2010 |
| JP | 5-322387 | 12/1993 |
| JP | 5322387 | 12/1993 |
| JP | 6-082083 | 3/1994 |
| JP | 6082083 | 3/1994 |
| JP | 6-147602 | 5/1994 |
| JP | 6147602 | 5/1994 |
| JP | 11148696 | 6/1999 |
| KR | 20080017581 | 2/2008 |
| KR | 1020080017581 | 2/2008 |
| KR | 20100038785 | 4/2010 |
| WO | 90/08925 | 8/1990 |
| WO | 97/11417 | 3/1997 |

OTHER PUBLICATIONS

Chinese Office Action for Chinese Patent Application 201080058783.9, mailed Apr. 25, 2014, 19 pgs.

International Search Report and Written Opinion for International Appl. No. PCT/US2010/061311 dated Aug. 25, 2011, 9 pages.

* cited by examiner

APPARATUS FOR CONTROLLING RELATIVE HUMIDITY IN A CONTAINER

BACKGROUND

Transporting and storing temperature sensitive cargo over periods of time may require a controlled climate in the space where the cargo is loaded. Climate control includes controlling the temperature of the cargo to be within a certain predefined acceptable range. Controlling the temperature includes bringing the temperature of the cargo into an acceptable range (by refrigerating or heating) and maintaining the temperature within that range. Climate control may also include controlling the humidity of the space where cargo is loaded.

The temperature of temperature sensitive cargo should be kept within predefined acceptable limits. Some cargo must be maintained frozen, and the temperature of any part of the frozen cargo must be kept below a predefined freezing temperature which depends on the cargo, e.g. below 10 degrees Fahrenheit or lower, while commodities such as fresh fruit and vegetables should be kept chilled, but not frozen, to stay fresh.

During operation of a refrigeration system water vapor will condensate on the evaporator and form a layer of ice that will degrade the efficiency of the evaporator and thereby of the refrigeration system. The ice is removed by running a defrosting cycle. Traditionally, defrosting cycles are initiated according to a predetermined schedule at time intervals which may depend on the nature of the cargo and the time since its loading into the container.

Some cargoes need relative humidity to be kept below acceptable upper limits. Some of these cargoes are also sensitive to temperatures, while others are relatively insensitive to temperature. Examples of such products are electronic and optical products, scientific instruments, machinery and metals such as iron and steel that may corrode if the relative humidity is too high, clothing and other textiles where fungus growth can be prevented by keeping the relative humidity low.

SUMMARY

In one embodiment, the invention provides a refrigeration system having a compressor configured to compress a refrigerant gas and a condenser fluidly coupled to the compressor to receive compressed refrigerant gas from the compressor, the condenser configured to condense the refrigerant gas. In addition the refrigeration system includes a heat exchanger having a first section fluidly coupled to the compressor, and a second section fluidly coupled between the condenser and the compressor, wherein the first section receives compressed refrigerant gas from the compressor, and wherein the second section receives condensed refrigerant from the condenser, evaporates the refrigerant, and delivers the evaporated refrigerant to the compressor.

In another embodiment the invention provides a method of operating a refrigeration system, the method including compressing a refrigerant with a compressor and condensing compressed refrigerant gas from the compressor in a condenser. The method further includes receiving into a first section of a heat exchanger compressed refrigerant gas from the compressor, evaporating condensed refrigerant from the condenser in a second section of the heat exchanger, and delivering the evaporated refrigerant from the second section to the compressor.

In yet another embodiment the invention provides a method of operating a refrigeration system, the method including measuring a relative humidity of a container. In addition, the method includes comparing the measured relative humidity to a humidity set point, and operating evaporator fans of a refrigeration system when the measured relative humidity is above the humidity set point.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
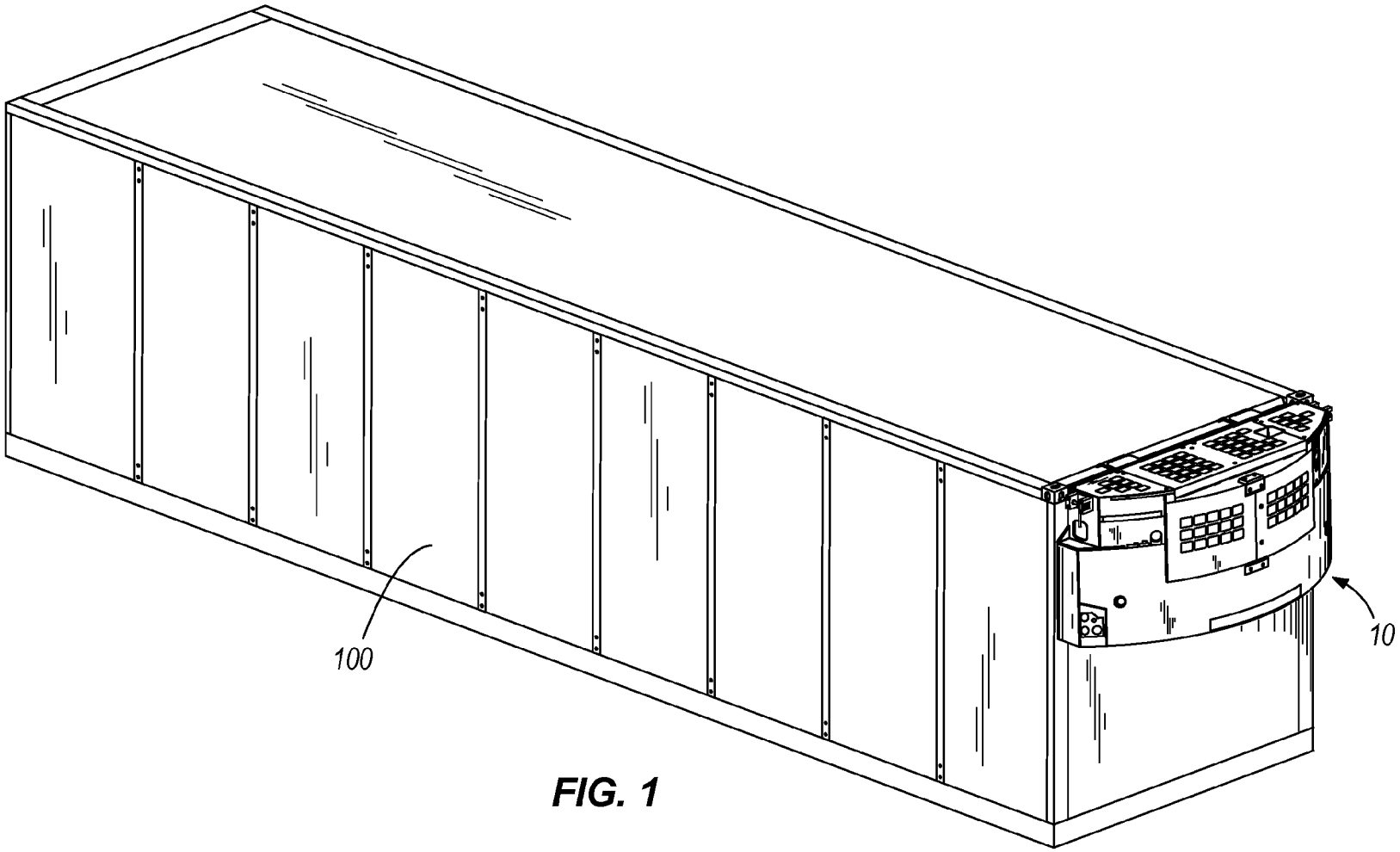
FIG. 1 is a perspective view of a container for transporting cargo.

FIG. 1 is a perspective view of a container 100 that is used for transporting cargo of various types. Coupled to one end of the container is a refrigeration system 10 which is used to control the climate, including the humidity level, of the interior of the container 100. The container 100 could alternatively be a trailer, a railroad car, a straight truck cargo space, or other storage compartment used to transport cargo.

Figure 2:
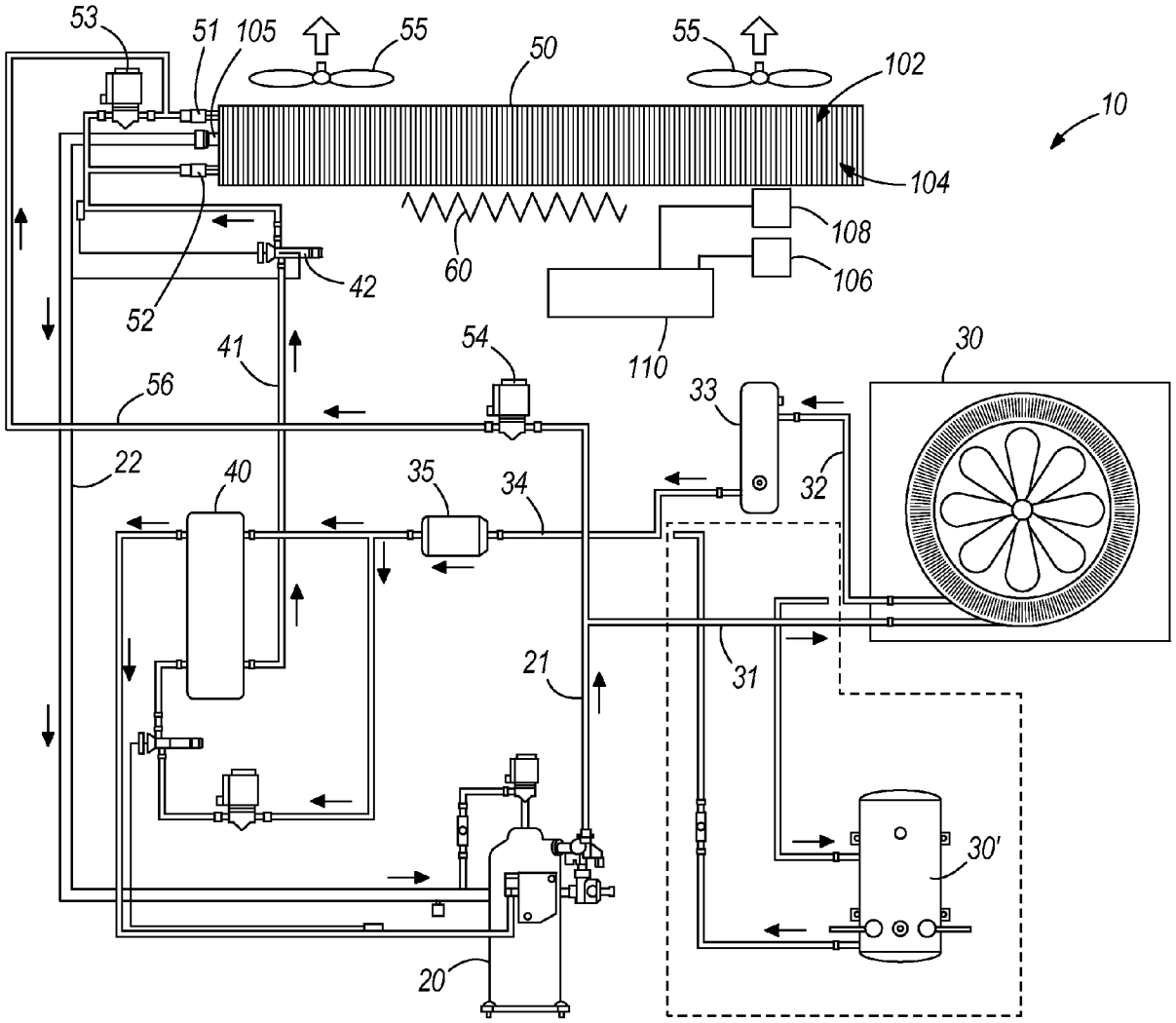
FIG. 2 is a schematic view of a refrigeration system which includes a dehumidification system.

FIG. 2 is a schematic view of the refrigeration system 10 which includes a dehumidification system. The illustrated embodiment includes a refrigeration system 10 with a compressor 20 which in operation compresses a refrigerant used in the refrigeration system 10. Compressed and hot refrigerant is conducted from the compressor 20 through conduits 21 and 31 to a condenser 30 where heat energy is removed from the refrigerant. The shown condenser 30 is fan assisted, and condensed and cooled refrigerant leaves the condenser 30 through a conduit 32 and enters a receiver tank 33. If additional cooling of the refrigerant is desired, an optional water-cooled condenser 30' (shown in a dash-line frame) may be used. From the receiver tank 33 (or optionally the water-cooled condenser 30') the condensed refrigerant is conducted through a conduit 34 (e.g., a liquid line) through a drier oil filter 35 to an economizer heat exchanger 40 and through a conduit 41 and a thermostatic expansion valve 42 to an evaporator 50. Fans 55 circulate the air through the evaporator 50 and through the interior of the container 100 in a direction shown by the arrows.

The evaporator 50 has a first part 102 and a second part 104. The evaporator 50 is a tube-fin-type heat exchanger. The refrigerant in the first part 102 and the second part 104 remains separate until the refrigerant reaches a discharge point 105. Thus, the refrigerant contained in the tubes of the first part 102 does not mix with any refrigerant contained in the tubes of the second part 104 until the refrigerant cycles through the first part 102 or the second part 104 to the discharge point 105, where the tubes of the first and second parts 102, 104 combine into a discharge header, for example. When the refrigerant reaches the discharge point 105 the refrigerant from the first part 102 and the second part 104 mixes and is returned to the compressor 20 via a return conduit 22. However, the first part 102 and the second part 104 are thermally connected. In other words, the fins that assist in transferring heat to and from the tubes are interconnected between both the tubes of the first and second parts 102, 104 of the evaporator 50.

The refrigeration system 10 has a first distributor 51 and a second distributor 52 each of which is connected to receive cold condensed refrigerant from the conduit 41 and the thermostatic expansion valve 42. The first distributor 51 feeds refrigerant to the tubes of the first part 102 of the evaporator 50, and the second distributor 52 feeds refrigerant to the tubes of the second part 104 of the evaporator 50. On its upstream side the first distributor 51 is connected to a first control valve 53. A second control valve 54 is connected to the conduit 21 that conducts hot compressed refrigerant gas from the compressor 20 to the second control valve 54. A conduit 56 connects the outlet of the second control valve 54 with the inlet of the first distributor 51.

In an alternative construction the refrigeration system does not include the first control valve 53 and the first section 102 is not connected to the conduit 41 that conducts refrigerant from the economizer 40 and the condenser 30. Thus, in this alternative construction, if the second control valve 54 is open then hot refrigerant is received into the first section 102. If the second control valve 54 is closed, then no refrigerant whatsoever is circulated through the first section 102.

A controller 110 controls the operation of the refrigeration system 10. A thermometer 108 measures the temperature of the interior of the container 100 and relays the temperature to the controller 110. An electric heating element 60 is arranged adjacent the evaporator 50. A humidity sensor 106 is arranged for sensing the relative humidity of the air in the container 100 and outputs a corresponding signal to the controller 110 for determining whether the relative humidity is within acceptable limits.

The refrigeration system 10 addresses the problem of reducing the relative humidity, in particular when the cargo is relatively insensitive to temperature. The method of the invention uses a refrigeration system and operates the refrigeration system to cause the temperature of the air to increase whereby the relative humidity is reduced. Preferably, the evaporator fans 55 are initially operated to cause the air to circulate within the container 100. The friction heat that is generated by the circulating air will cause the temperature to increase and in consequence the relative humidity will decrease. The refrigeration system 10 may further be operated to activate the electric heating element 60. This use of the refrigeration system 10 for heating the air to reduce the relative humidity without refrigerating or dehumidifying is advantageous and allows a refrigeration system to be used for other purposes than refrigeration and other traditional uses.

If it is determined that the relative humidity is higher than desired, i.e. higher than a predetermined value, heat generating means of the refrigeration system 10 are activated to heat the air in the container and thereby reduce the relative humidity. Humidity is not extracted from the air by heating alone and the absolute humidity will remain constant, but since the capacity of the air to absorb or contain water vapor increases with increasing temperature, the relative humidity will decrease with increasing temperature.

Specifically, the heat generating means of the refrigeration system 10 that are activated to heat the air in the container 100 comprises one or more of the fans 55 that are arranged to circulate the air in the container 100 past the evaporator 50 and through the container 100. Circulating the air in the container 100 requires energy which is dissipated as heat due to friction between the air and the container walls and the cargo in the container 100. The dissipated heat will increase the temperature of the air and the relative humidity will thereby be correspondingly reduced.

If the friction heat generated using one or more of the fans 55 to circulate the air in the container 100 is not enough to keep the relative humidity below the predetermined acceptable value, the electric heating element 60 may additionally be activated. The fan/fans 55 circulate the air in the container 100 past the heating element 60 whereby the air is further heated in addition to the friction heat generated by circulating the air.

The refrigeration system 10 also addresses the problem of reducing the relative humidity, in particular when the cargo is sensitive to temperature. This invention is useful for dehumidifying the air in the container 100 while still maintaining the cargo chilled. For example, fresh fruit generates water vapor that needs be removed by dehumidification for which traditionally the refrigeration system is used. Dehumidification is done by operating the refrigeration system in a first mode to refrigerate the air whereby water vapor condensates on the evaporator coil. In case of high humidity, elevated dehumidification will be necessary which involves running one or more sections of the evaporator coil at correspondingly elevated refrigeration power in order to condensate the water vapor. Thereby the air may become refrigerated below a critical minimum temperature (e.g. bananas must be kept at a temperature not lower than 13 degrees C.). Refrigeration below the critical minimum temperature must be avoided. Traditionally, in order to compensate for the elevated refrigeration an electric heating element is activated. Instead, according to the invention, heating energy already produced by the refrigeration system 10 is used. When the refrigerant leaves the compressor it is "hot" and traditionally all the hot refrigerant is condensed and cooled in the condenser where a condenser fan removes the heat before the "cold" refrigerant is conducted to the evaporator. According to the invention, the refrigeration system will operate in a second mode of operation where a portion of the compressed refrigerant from the compressor bypasses the condenser and is fed to a section of the evaporator coil as "hot gas".

In the first mode of operation the first control valve 53 is open and the second control valve 54 is closed. The refrigerant will then flow in the closed circuit from the compressor 20 through conduits 21 and 31, condenser 30, receiver tank 33, conduit 34, drier oil filter 35, heat exchanger 40, conduit 41, expansion valve 42, first and second distributors 51, 52, first part 102 and second part 104 of the evaporator 50 and return conduit 22 back to the compressor 20. The first mode of operation is thus a traditional refrigeration mode where both the first and the second distributor 51, 52 receive cold refrigerant which is fed into both the first and the second parts 102, 104 of the evaporator 50.

In the second mode of operation the first control valve 53 is closed, and the first distributor 51 will no longer receive cold refrigerant as in the first mode of operation. The second control valve 54 is opened so that hot refrigerant from the compressor will be conducted through conduit 21, the second control valve 54 and conduit 55 to the inlet of the first distributor 51 and into the first part 102 of the evaporator 50. The second distributor 52 and the second part 104 of the evaporator 50 will still receive cold refrigerant like in the first mode of operation described above. Thus the second part 104 of the evaporator 50 can be operated to achieve the desired temperature. If the air in the container 100 is thereby refrigerated to an unacceptable low temperature, the second control valve 54 is opened to conduct hot refrigerant to the first part 102 of the evaporator 50 whereby the air that is drawn through the evaporator 50 by means of the fans 55 will be heated to raise the temperature of the air in the interior of container 100. Thus the air in the interior of the container 100 is controlled to be at a desired relative humidity level.

The refrigeration system 10 may also be used to defrost the evaporator 50 when ice has accumulated on the evaporator 50. In order to defrost the evaporator 50, the supply of cold refrigerant to the evaporator 50 is stopped and hot refrigerant from the compressor 20 is sent to the first part 102 of the evaporator 50 as described above. As the evaporator 50 is not receiving any cold refrigerant, the heat from the hot refrigerant in the first part 102 of the evaporator 50 will warm the entire evaporator 50, thus melting the ice from the evaporator 50.

Thus, the invention provides, among other things, an apparatus for controlling humidity in a container. Various features and advantages of the invention are set forth in the following claims.

What is claimed is:

1. A method of operating a refrigeration system, the method comprising:

a humidity sensor measuring a relative humidity of a container;

comparing the measured relative humidity determined using the humidity sensor to a first humidity set point; and operating the refrigeration system using a first dehumidification technique, the first dehumidification technique including operating evaporator fans of the refrigeration system when the measured relative humidity determined using the humidity sensor is above the first humidity set point to reduce the relative humidity of the container;

comparing the measured relative humidity to an elevated humidity set point, the elevated humidity set point being greater than the first humidity set point; and operating the refrigeration system using a second dehumidification technique, the second dehumidification technique including operating both an electric heater of the refrigeration system and the evaporator fans, when the relative humidity of the container is above the elevated humidity set point, wherein the electric heater is arranged adjacent to an evaporator of the refrigeration system and the electric heater is configured to heat air that is to be circulated within the container in order to lower the relative humidity of the container.

2. The method of claim 1, further comprising operating the electric heater of the refrigeration system if operation of the evaporator fans alone is insufficient to lower the relative humidity below the first humidity set point, wherein the electric heater is arranged adjacent to the evaporator of the refrigeration system and the electric heater is configured to heat air that is to be circulated within the container in order to lower the relative humidity of the container.

3. The method claim 2, further comprising operating the evaporating fans for a period of time when the measured relative humidity is above the first humidity set point, and operating the electric heater after the period of time if operation of the evaporator fans alone is insufficient to lower the relative humidity below the first humidity set point.

4. The method of claim 1, further comprising operating the evaporator fans while not operating a compressor of the refrigeration system.

5. The method of claim 1, further comprising directing refrigerant directly from a compressor of the refrigeration system to the evaporator of the refrigeration system when the measured relative humidity is above the first humidity set point.

6. The method of claim 5, wherein directing refrigerant directly from the compressor of the refrigeration system to the evaporator of the refrigeration system includes the refrigerant bypassing a condenser of the refrigeration system.

7. The method of claim 1, further comprising when the measured relative humidity is above the first humidity set point:

closing a first control valve positioned between a condenser of the refrigeration system and an inlet of a first distributor of the evaporator of the refrigeration system thereby preventing refrigerant from the condenser of the refrigeration system from entering the inlet of the first distributor of the evaporator; and opening a second control valve positioned between a compressor of the refrigeration system and the inlet of the first distributor of the evaporator thereby directing at least a portion of refrigerant from the compressor directly to the first distributor of the evaporator and bypassing the condenser of the refrigeration system.

8. The method of claim 7, further comprising when the measured relative humidity is above the first humidity set point directing a second portion of the refrigerant from the condenser to an inlet of a second distributor of the evaporator.

9. The method of claim 1, further comprising when the measured relative humidity is not above the first humidity set point:

opening a first control valve positioned between a condenser of the refrigeration system and an inlet of a first distributor of the evaporator of the refrigeration system thereby directing refrigerant from the condenser of the refrigeration system into the inlet of the first distributor of the evaporator; and closing a second control valve positioned between a compressor of the refrigeration system and the inlet of the first distributor of the evaporator thereby preventing refrigerant from the compressor from passing directly to the first distributor of the evaporator.

10. A method of reducing a humidity level within a transport compartment using a refrigeration system, the method comprising:

measuring a relative humidity of the transport compartment;

comparing the measured relative humidity to a first humidity set point; and operating the refrigeration system using a first dehumidification technique, the first dehumidification technique including operating evaporator fans of the refrigeration system when the measured relative humidity is above the first humidity set point;

comparing the measured relative humidity to an elevated humidity set point, the elevated humidity set point being greater than the first humidity set point; and operating the refrigeration system using a second dehumidification technique, the second dehumidification technique including operating both an electric heater of the refrigeration system and the evaporator fans when the relative humidity of the transport compartment is above the elevated humidity set point, wherein the electric heater is arranged adjacent to an evaporator of the refrigeration system and the electric heater is configured to heat air that is to be circulated within the transport compartment in order to lower the relative humidity of the transport compartment.

11. The method of claim 10, further comprising operating the electric heater of the refrigeration system if operation of the evaporator fans alone is insufficient to lower the relative humidity below the first humidity set point, wherein the electric heater is arranged adjacent to the evaporator of the refrigeration system and the electric heater is configured to heat air that is to be circulated within the transport compartment in order to lower the relative humidity of the transport compartment.

12. The method claim 11, further comprising operating the evaporating fans for a period of time when the measured relative humidity is above the first humidity set point, and operating the electric heater after the period of time if operation of the evaporator fans alone is insufficient to lower the relative humidity below the first humidity set point.

13. The method of claim 10, further comprising operating the evaporator fans while not operating a compressor of the refrigeration system.

14. The method of claim 10, further comprising directing refrigerant directly from a compressor of the refrigeration system to the evaporator of the refrigeration system when the measured relative humidity is above the first humidity set point.

15. The method of claim 14, wherein directing refrigerant directly from the compressor of the refrigeration system to the evaporator of the refrigeration system includes the refrigerant bypassing a condenser of the refrigeration system.

16. The method of claim 10, further comprising when the measured relative humidity is above the first humidity set point:

closing a first control valve positioned between a condenser of the refrigeration system and an inlet of a first distributor of the evaporator of the refrigeration system thereby preventing refrigerant from the condenser of the refrigeration system from entering the inlet of the first distributor of the evaporator; and opening a second control valve positioned between a compressor of the refrigeration system and the inlet of the first distributor of the evaporator thereby directing at least a portion of refrigerant from the compressor directly to the first distributor of the evaporator.

17. The method of claim 16, wherein directing the at least the portion of refrigerant from the compressor directly to the first distributor evaporator includes the at least the portion of refrigerant bypassing the condenser of the refrigeration system.

18. The method of claim 16, further comprising when the measured relative humidity is above the first-humidity set point directing a second portion of the refrigerant from the condenser to an inlet of a second distributor of the evaporator.

19. A method of operating a refrigeration system, the method comprising:

a humidity sensor measuring a relative humidity of a container;

comparing the measured relative humidity determined using the humidity sensor to a first humidity set point;

operating the refrigeration system using a first dehumidification technique, the first dehumidification technique including operating evaporator fans of the refrigeration system when the measured relative humidity determined using the humidity sensor is above the first humidity set point to reduce the relative humidity of the container;

comparing the measured relative humidity to an elevated humidity set point, the elevated humidity set point being greater than the first humidity set point; and operating the refrigeration system using a second dehumidification technique, the second dehumidification technique including operating an electric heater of the refrigeration system when operation of the refrigeration system using the first humidification technique alone is insufficient to lower the relative humidity below the first humidity set point, wherein the electric heater is arranged adjacent to an evaporator of the refrigeration system and the electric heater is configured to heat air that is to be circulated within the container in order to lower the relative humidity of the container.

20. The method claim 19, further comprising the first dehumidification technique operating the evaporating fans for a period of time when the measured relative humidity is above the first humidity set point, and the second dehumidification technique operating the electric heater after the period of time if operation of the first dehumidification technique of operating the evaporator fans alone is insufficient to lower the relative humidity below the first humidity set point.

* * * * *